US011565862B2

(12) United States Patent
Ball

(10) Patent No.: US 11,565,862 B2
(45) Date of Patent: Jan. 31, 2023

(54) CARTON AND BLANK THEREFOR

(71) Applicant: WestRock Packaging Systems, LLC, Atlanta, GA (US)

(72) Inventor: Nathaniel B. Ball, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/291,399

(22) PCT Filed: Nov. 7, 2019

(86) PCT No.: PCT/US2019/060232
§ 371 (c)(1),
(2) Date: May 5, 2021

(87) PCT Pub. No.: WO2020/097307
PCT Pub. Date: May 14, 2020

(65) Prior Publication Data

US 2022/0002053 A1 Jan. 6, 2022

Related U.S. Application Data

(60) Provisional application No. 62/757,935, filed on Nov. 9, 2018.

(51) Int. Cl.
*B65D 71/36* (2006.01)
*B31B 50/81* (2017.01)
(Continued)

(52) U.S. Cl.
CPC ..... *B65D 71/36* (2013.01); *B31B 50/81* (2017.08); *B31B 50/624* (2017.08);
(Continued)

(58) Field of Classification Search
CPC ..... B31B 50/81; B31B 2120/302; B65D 5/02; B65D 5/0263; B65D 5/54; B65D 71/00;
(Continued)

(56) References Cited

U.S. PATENT DOCUMENTS 4,925,019 A * 5/1990 Ganz ..... B65D 71/36 206/427
5,197,598 A * 3/1993 Stout ..... B65D 71/36 206/427
(Continued)

*Primary Examiner* — Bryon P Gehman
(74) *Attorney, Agent, or Firm* — Neil G. Cohen

(57) ABSTRACT

Aspects of the disclosure relate to a package, a carton, and a blank for forming the carton. An aspect of the invention provides a carton comprising a plurality of panels defining an interior of the carton. The plurality of panels comprises a first panel and a second panel hingedly connected to the first panel. An end closure panel is hingedly connected to the first panel. A foldable gusset is disposed in the interior of the carton. The gusset hingedly connecting between the end closure panel and the second panel. A gusset opening is defined, at least, in panels forming the gusset. The carton comprises an opening feature which is at least partially removable from the carton. The opening feature is defined at least in part by first and second tear lines each extending from the gusset opening.

15 Claims, 6 Drawing Sheets

(51) Int. Cl.
*B31B 120/30* (2017.01)
*B31B 50/62* (2017.01)

(52) U.S. Cl.
CPC ..... *B31B 2120/302* (2017.08); *B65D 2571/0045* (2013.01); *B65D 2571/0066* (2013.01); *B65D 2571/00141* (2013.01); *B65D 2571/00574* (2013.01); *B65D 2571/00728* (2013.01)

(58) Field of Classification Search
CPC ..... B65D 71/36; B65D 2571/00141; B65D 2571/0045; B65D 2571/00574; B65D 2571/0066; B65D 2571/0728
USPC ..... 206/427; 229/122.1
See application file for complete search history.

(56) References Cited

U.S. PATENT DOCUMENTS 5,292,059 A * 3/1994 Oliff ..... B65D 5/0263 229/137
6,959,857 B2 * 11/2005 Bates ..... B65D 5/725 206/427
6,981,631 B2 * 1/2006 Fogle ..... B65D 71/34 206/431

* cited by examiner

CARTON AND BLANK THEREFOR

TECHNICAL FIELD

The present invention relates to product packaging, to article carriers or cartons, and to blanks for forming the same. More specifically, but not exclusively, the invention relates to a carton having a dispensing feature for accessing the contents of the carton.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide a carton or article carrier having dispensing feature for accessing the contents of the carrier. It is desirable that the articles are retained within the interior of carton when the dispensing feature is deployed.

The present invention seeks to provide an improvement in the field of cartons and carton blanks, typically formed from paperboard or the like.

SUMMARY

A first aspect of the disclosure provides a carton for packaging one or more articles. The carton comprises a plurality of panels defining an interior of the carton. The plurality of panels comprises a first panel and a second panel hingedly connected to the first panel. An end closure panel is hingedly connected to the first panel. A foldable gusset is disposed in the interior of the carton. The gusset is hingedly connected between the end closure panel and the second panel. A gusset opening is defined, at least, in panels forming the gusset. The carton comprises an opening feature which is at least partially removable from the carton. The opening feature is defined at least in part by first and second tear lines each extending from the gusset opening.

Optionally, the first tear line extends in one of the first panel, the second panel and the end closure panel and the second tear line extends in another one of the first panel, the second panel and the end closure panel.

A second aspect of the disclosure provides a carton for packaging one or more articles. The carton comprises a plurality of panels defining an interior of the carton. The plurality of panels comprises a first panel and a second panel hingedly connected together along a fold line. The carton comprises an opening feature which is at least partially removable therefrom. The opening feature is defined, at least in part, by first and second tear lines. The first tear line extends between the fold line and a tear initiation feature located in the first panel. The second tear line extends obliquely with respect to the fold line such that an obtuse angle is subtended between the fold line and the second tear line. A tear barricade line is formed in a portion of the second panel where the obtuse angle is subtended.

Optionally, the second tear line is defined at least in part by an edge of an opening.

Optionally, the tear barricade line is located adjacent to an intersection of the fold line and the first tear line.

A third aspect of the disclosure provides a carton for packaging one or more articles. The carton comprises: a first panel; a second panel hinged to the first panel along a first fold line; a first corner panel hinged to the second panel along a second fold line; and a second corner panel hinged to the second panel along a third fold line. The first fold line is disposed between the second and third fold lines such that the second and third fold lines extend divergently away from the first fold line. The carton further comprises an opening feature which is at least partially removable from the carton. The opening feature comprises a tear initiation feature located in the first panel. The opening feature is defined at least in part by first, second, third and fourth tear lines. The first and third tear lines extend divergently from the tear initiation feature toward the first fold line. Each of the second and fourth tear lines is coextensive with a respective one of the second and third fold lines.

Optionally, the first tear line extends between the tear initiation feature and the one of the opposite ends of the first fold line and the third tear line extends between the tear initiation feature and the other of the opposite ends of the first fold line.

A fourth aspect of the disclosure provides a carton for packaging one or more articles. The carton comprises a plurality of panels defining an interior of the carton. The plurality of panels comprises a first panel and a second panel. The second panel is hingedly connected to the first panel. The carton comprises an end closure panel hingedly connected to the first panel and a foldable gusset for placement into the interior of the carton. The gusset hingedly connects between the end closure panel and the second panel. The carton further comprises an opening feature which is at least partially removable from the carton. The opening feature is defined at least in part by first and second tear lines, the second tear line is coextensive with at least a portion of an edge of the second panel, the edge being defined, at least in part, by a hinged connection to the gusset.

Optionally, the second panel forms a top panel of the carton.

Optionally, the first panel forms a side or end panel of the carton.

Optionally, the foldable gusset is formed from a pair of web panels hingedly connected to each other.

Optionally, the carton comprises a gusset opening defined, at least, in the pair of web panels.

Optionally, the first and second tear lines each extend from the gusset opening.

Optionally, the second tear line which is coextensive with the portion of the edge of second panel is defined, at least in part, by the gusset opening.

A fifth aspect of the disclosure provides a blank for forming a carton. The blank comprises a plurality of panels for defining an interior of the carton. The plurality of panels comprises: a first panel, a second panel hingedly connected to the first panel, an end closure panel hingedly connected to the first panel. The blank comprises a foldable gusset for placement into the interior of the carton. The gusset is hingedly connected between the end closure panel and the second panel. The blank comprises a gusset opening defined, at least, in the panels forming the gusset. The blank further comprises an opening feature which is at least partially removable. The opening feature is defined at least in part by first and second tear lines each extending from the gusset opening.

A fifth aspect of the disclosure provides a blank for forming a carton. The blank comprises a plurality of panels for at least partially defining an interior of the carton. The plurality of panels comprises a first panel and a second panel hingedly connected together along a fold line. The blank comprises an opening feature which is at least partially removable therefrom. The opening feature is defined, at least in part, by first and second tear lines. The first tear line extends between the fold line and a tear initiation feature located in the first panel. The second tear line extends obliquely with respect to the fold line such that an obtuse angle is subtended between the fold line and the second tear line. A tear barricade line is formed in a portion of the second panel where the obtuse angle is subtended.

A fifth aspect of the disclosure provides a blank for forming a carton. The blank comprises a plurality of panels including: a first panel, a second panel hinged to the first panel along a first fold line, a first corner panel hinged to the second panel along a second fold line and a second corner panel hinged to the second panel along a third fold line. The first fold line is disposed between the second and third fold lines such that the second and third fold lines extend divergently away from the first fold line. The blank further comprises an opening feature which is at least partially removable. The opening feature comprises a tear initiation feature located in the first panel. The opening feature is defined at least in part by first, second, third and fourth tear lines. The first and third tear lines extends divergently from the tear initiation feature toward the first fold line. The second and fourth tear lines are coextensive with the second and third fold lines respectively.

A sixth aspect of the disclosure provides a blank for forming a carton. The blank comprises a plurality of panels for defining an interior of the carton. The plurality of panels comprises a first panel and a second panel. The second panel is hingedly connected to the first panel. The blank comprises an end closure panel hingedly connected to the first panel and a foldable gusset for placement into the interior of the carton. The gusset is hingedly connected between the end closure panel and the second panel. The blank further comprises an opening feature which is at least partially removable. The opening feature is defined at least in part by first and second tear lines. The second tear line is coextensive with at least a portion of an edge of the second panel, the edge is defined, at least in part, by a hinged connection to the gusset.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, carton and blank are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, cartons and blanks described herein may be embodied in various and alternative forms. The Figures are not necessarily to scale, and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
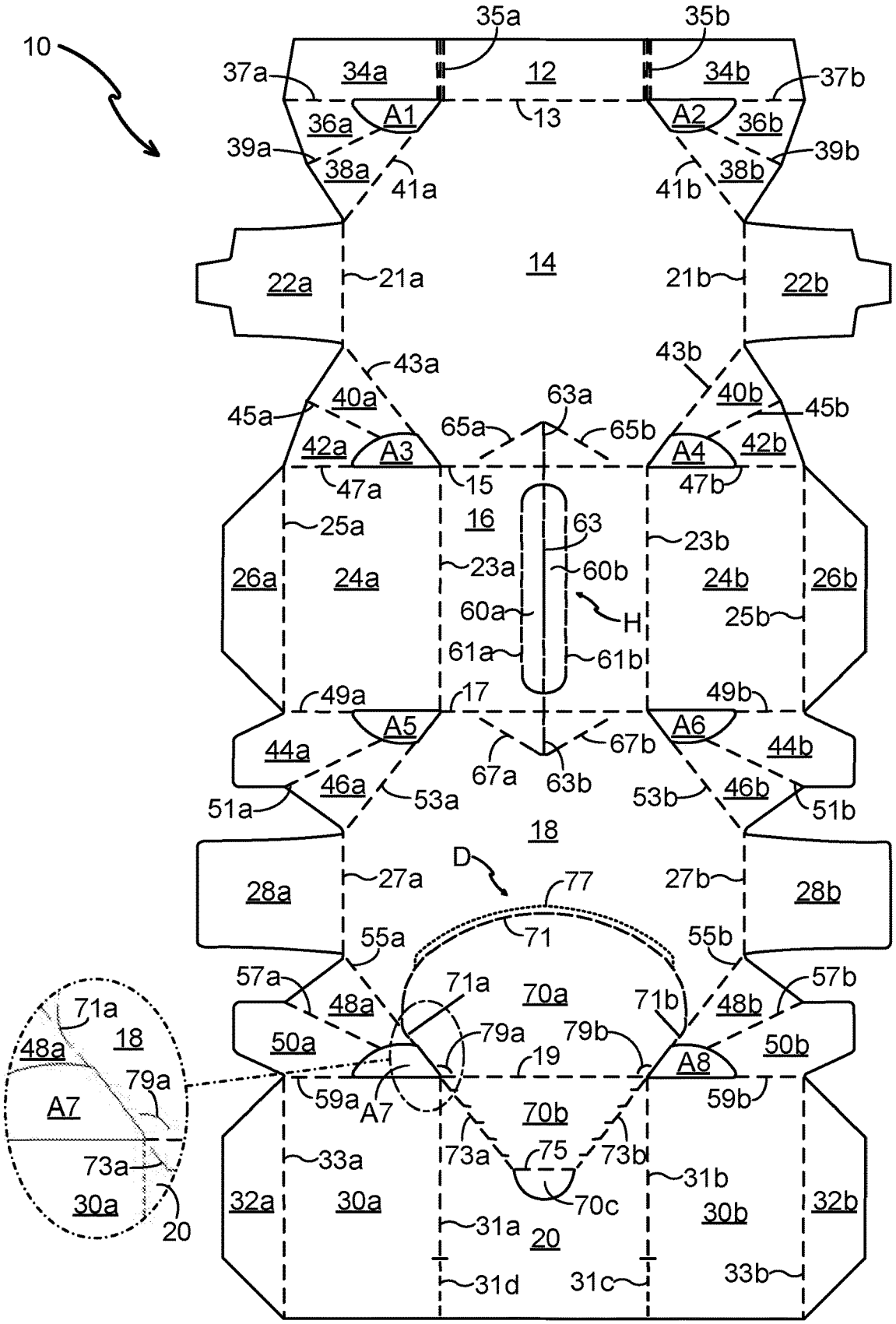
FIG. 1 is a plan view from above of a blank for forming an article carrier according to a first embodiment.
Figure 2:
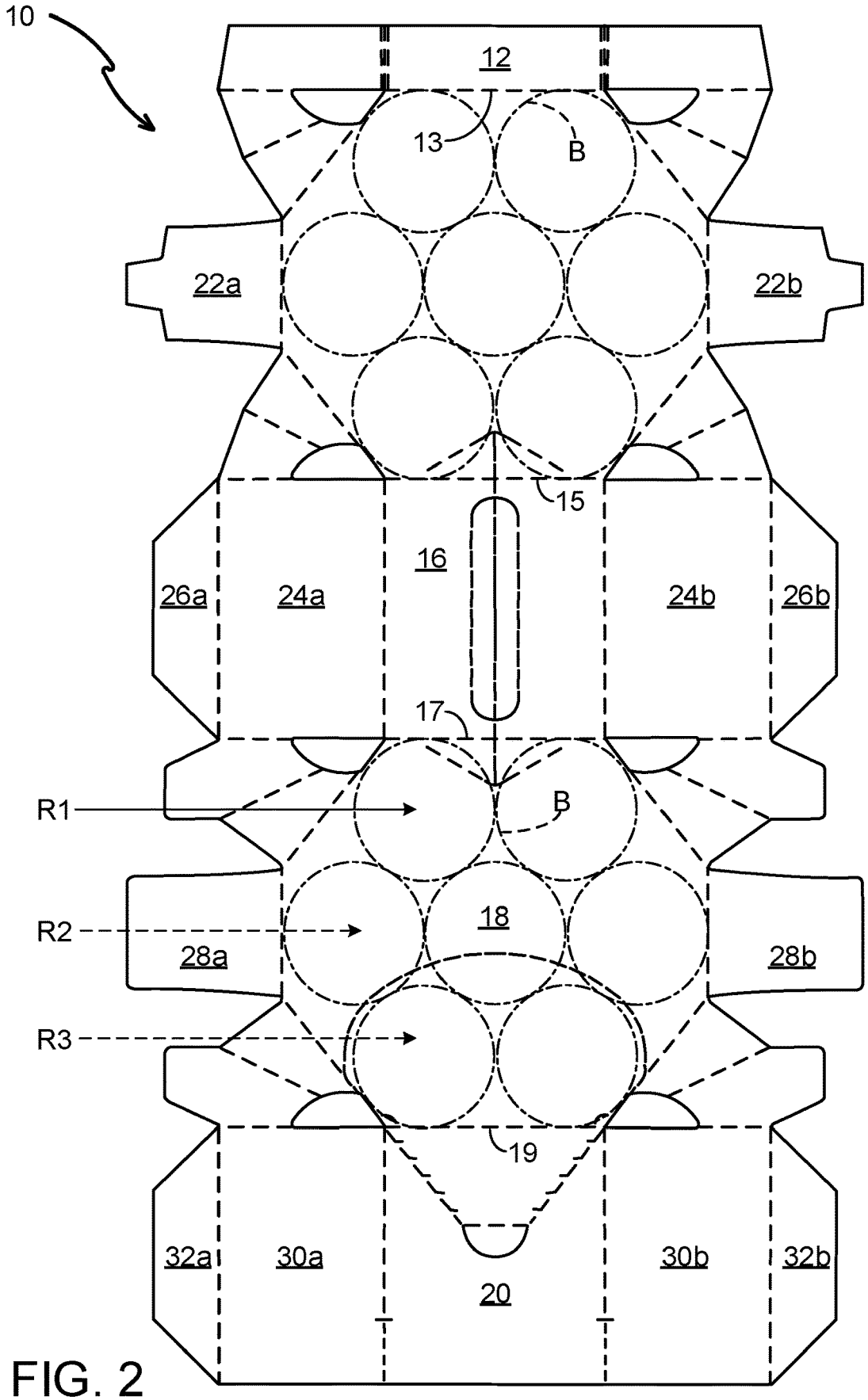
FIG. 2 is a plan view from above of the blank of FIG. 1 showing the arrangement of a plurality of articles with respect to top and bottom panels of the blank.
Figure 3:
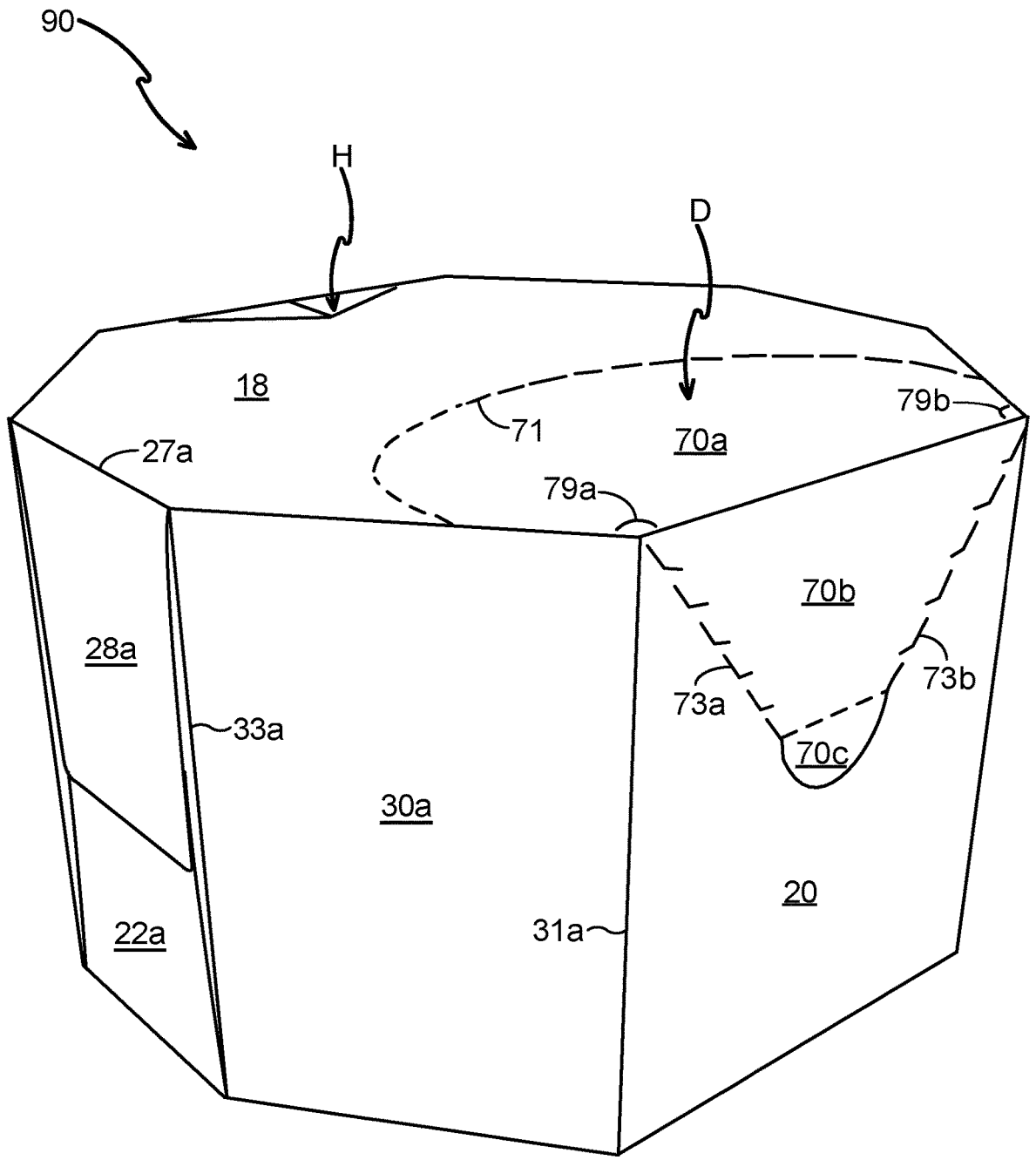
FIG. 3 is a perspective view of an article carrier formed from the blank of FIG. 1.

Referring to FIGS. 1 and 2, there is shown plan views of a blank 10, according to an embodiment of the disclosure, capable of forming a package in the form of an article carrier or carton 90, as shown in FIG. 3, for containing and carrying a group of primary products such as, but not limited to, cans, hereinafter referred to as articles B.

Figure 5A:
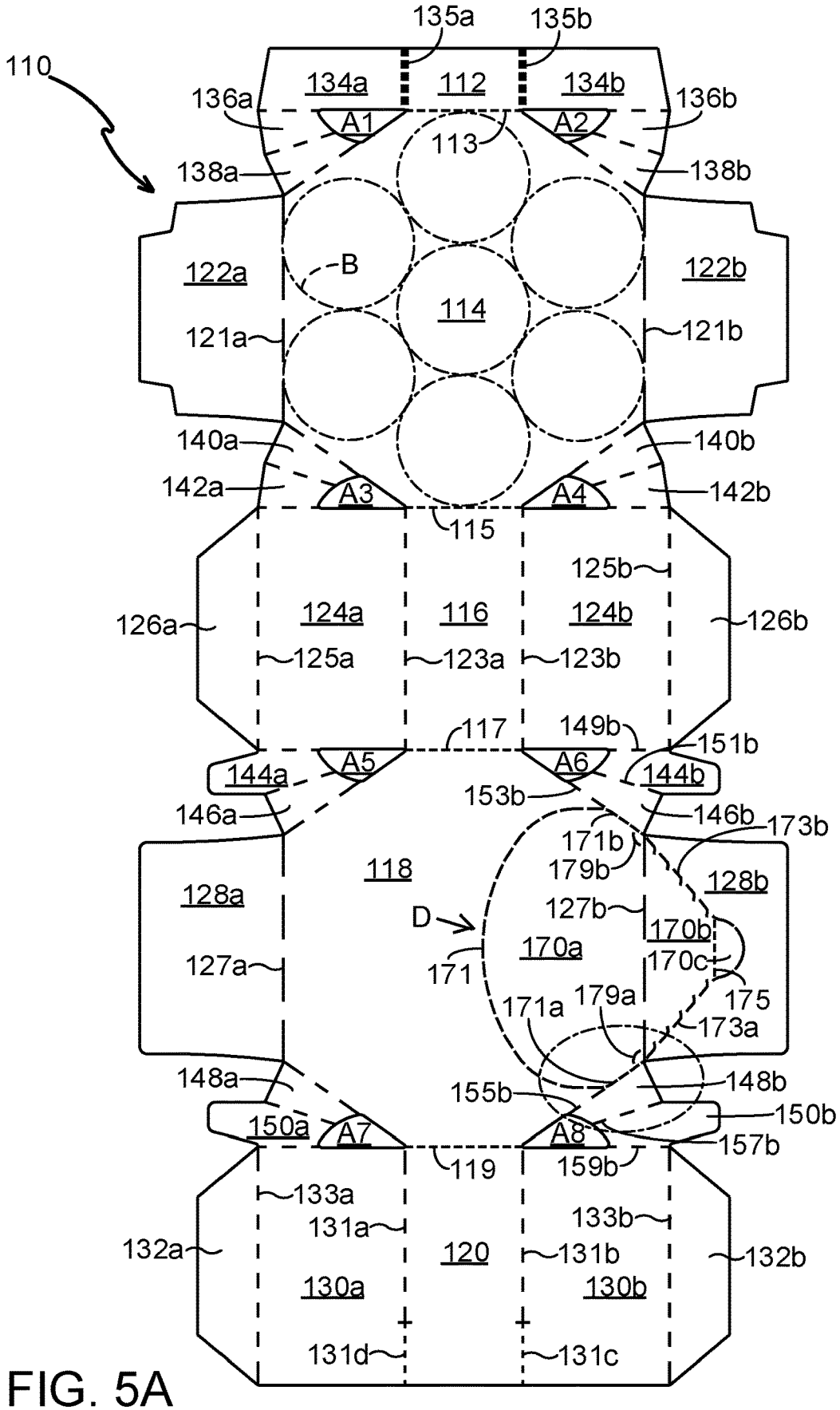
FIG. 5A is a plan view from above of a blank for forming an article carrier according to a second embodiment.
Figure 6:
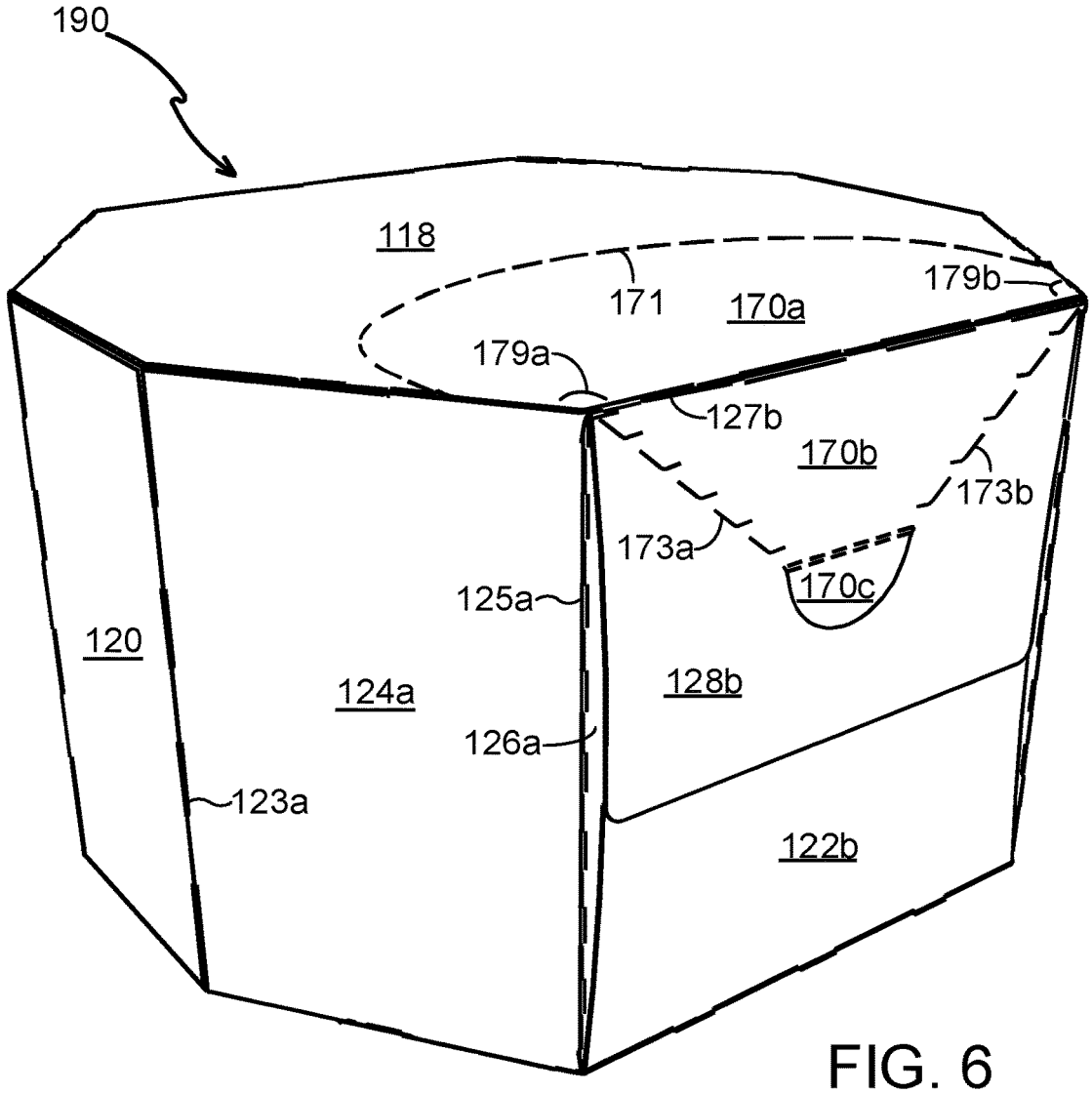
FIG. 6 is a perspective view of an article carrier formed from the blank of FIG. 5A.

FIG. 5A shows a plan view of a blank 110, according to another embodiment of the disclosure, capable of forming an article carrier or carton 190, as shown in FIG. 6.

In the embodiments detailed herein, the terms "carton" and "carrier" refer, for the non-limiting purpose of illustrating the various features of the invention, to a container 90, 190 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, pouches, packets and the like.

The blanks 10, 110 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The cartons 90, 190 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

In the embodiment illustrated in FIGS. 1 and 2, the blank 10 is configured to form a carton or carrier 90 for packaging an exemplary arrangement of exemplary articles B. In the illustrated embodiment the arrangement is a nested arrangement of articles, having three rows R1, R2, R3, the central row R2 comprises three articles, the outer (upper and lower) rows R1, R3 each comprise two articles, best shown in FIG. 2. The centres (tubular axes) of the articles in the outer rows are offset with respect to the centres (tubular axes) of the articles in the centre row. The centre (tubular axes) of an article in one of the outer rows may be substantially aligned with the centre (tubular axes) of an article in the other one of the outer rows; the centres of said articles define a notional line the notional line is disposed tangentially to each of a pair of articles in the centre row. Each of the aforesaid articles in the outer rows may be in touching contact with each of the pair of articles in the centre row; the pair of articles in the centre row may be in touching contact with each other. The articles B are cans, the illustrated example comprises 7.5 US fl. oz. (221 ml) 'mini' beverage cans, the cans may be formed from a suitable material such as, but not limited to, Aluminium. Alternatively, the blank 10 can be configured to form a carrier for packaging other types, number and size of articles B and/or for packaging articles B in a different arrangement or configuration for example, but not limited to, the articles B may be bottles, cups, pouches or pots.

In the embodiment illustrated in FIG. 5A, the blank 110 is configured to form a carton or carrier 190 for packaging an exemplary arrangement of exemplary articles B. In the illustrated embodiment the arrangement is a nested arrangement of articles, having three columns C1, C2, C3, the central column C2 comprises three articles, the outer (upper and lower) columns C1, C3 each comprise two articles. The centres (tubular axes) of the articles in the outer columns are offset with respect to the centres (tubular axes) of the articles in the centre column. The arrangement is substantially similar to that of the first illustrated embodiment shown in FIG. 2, albeit the arrangement has been rotated through ninety degrees to be oriented perpendicularly with respect to the arrangement of the first illustrated embodiment.

Turning to FIG. 1, there is illustrated a blank 10 for forming a carton 90 (see FIG. 3) according to a first embodiment. The blank 10 comprises a plurality of main or primary panels 12, 14, 16, 18, 20 for forming a tubular structure. The plurality of primary panels 12, 14, 16, 18, 20 comprises a securing flap 12, a base panel 14, a rear side panel 16, a top panel 18, and a front side panel 20. The plurality of primary panels 12, 14, 16, 18, 20 may be hingedly connected to each other, one to the next, in a linear series by a respective one of a plurality of hinged connections in the form of fold lines 13, 15, 17, 19.

The panels of the blank 10 are described with reference to a dispensing feature D which in use is provided in part in a second panel 18 forming a top wall or panel of the carton 90 and in part in a first, adjacently disposed, panel 20 forming a front side wall or panel of the carton 90, see FIG. 3. The carton 90 may also comprise a handle structure H, the handle structure H may be provided at least in part in a third panel 16 (not shown in FIG. 3 but in FIGS. 1 and 2). The third panel 16 may be arranged to oppose the first panel 20. The third panel 16, when the handle structure is in use, forms a top wall of the carton 90, however when the dispensing feature D is in use the third panel 16 forms rear side wall or panel of the carton 90.

The fourth or base panel 14 and the second or top panel 18 are octagonal in shape. The blank 10 comprises a plurality of major corner or bevel panels 24*a*, 24*b*, 30*a*, 30*b* which partially close ends of the tubular structure defined by plurality of primary panels 12, 14, 16, 18, 20.

The blank 10 comprises a first major corner panel 24*a* hingedly connected to a first end of the rear side panel 16 by a hinged connection in the form of a fold line 23*a*. The blank 10 comprises a second major corner panel 24*b* hingedly connected to a second end of the rear side panel 16 by a hinged connection in the form of a fold line 23*b*.

The blank 10 comprises a third major corner panel 30*a* hingedly connected to a first end of the front side panel 20 by a hinged connection in the form of a fold line 31*a*. The blank 10 comprises a fourth major corner panel 30*b* hingedly connected to a second end of the front side panel 20 by a hinged connection in the form of a fold line 31*b*.

The blank 10 comprises end closure structures for completing closure of the open ends of the tubular structure.

A first end closure structure comprises; a first bottom end closure panel 22*a* hingedly connected to a first end of the base panel 14 by a hinged connection in the form of a fold line 21*a*, a first top end closure panel 28*a* hingedly connected to a first end of the top panel 18 by a hinged connection in the form of a fold line 27*a*, a first side end closure panel 26*a* hingedly connected to the first major corner panel 24*a* by a hinged connection in the form of a fold line 25*a*, and a second side end closure panel 32*a* hingedly connected to the third major corner panel 30*a* by a hinged connection in the form of a fold line 33*a*.

A second end closure structure comprises; a second bottom end closure panel 22*b* hingedly connected to a second end of the base panel 14 by a hinged connection in the form of a fold line 21*b*, a second top end closure panel 28*b* hingedly connected to a second end of the top panel 18 by a hinged connection in the form of a fold line 27*b*, a third side end closure panel 26*b* hingedly connected to the second major corner panel 24*b* by a hinged connection in the form of a fold line 25*b*, and a fourth side end closure panel 32*b* hingedly connected to the fourth major corner panel 30*b* by a hinged connection in the form of a fold line 33*b*.

A first securing tab 34*a* is hingedly connected to a first end of the securing flap 12 by a hinged connection in the form of a fold line 35*a*. A second securing tab 34*b* is hingedly connected to a second end of the securing flap 12 by a hinged connection in the form of a fold line 35*b*.

The first securing tab 34*a* is hingedly connected to the base panel 14 by a first foldable gusset in the form of a first pair of web panels 36*a*, 38*a*, also referred to herein as minor corner panels (the first pair of web panels 36*a*, 38*a* is hinged to a first bevelled or chamfered corner of the base panel 14), the first pair of web panels 36*a*, 38*a* underlies the third major corner panel 30*a* in a setup condition. A first web panel 36*a* is hingedly connected to the first securing tab 34*a* by a hinged connection in the form of a fold line 37*a*. A second web panel 38*a* is hingedly connected to the first web panel 36*a* by a hinged connection in the form of a fold line 39*a*. The second web panel 38*a* is hingedly connected to the base panel 14 by a hinged connection in the form of a fold line 41*a*.

The fold line 37*a* is substantially collinear with the fold line 13.

Each of the first pair of web panels 36*a*, 38*a* is defined in part by a pair of divergently arranged fold lines 37*a*/39*a*, 39*a*/41*a*.

The blank 10 comprises a first aperture A1 struck from the first pair of web panels 36*a*, 38*a* so as to interrupt the fold lines 37*a*, 39*a*, 41*a*. The first aperture A1 is located at a position at which the fold lines 37*a*, 39*a*, 41*a* would otherwise have intersected with each other and with the fold lines 13 and 35*a*.

The second securing tab 34*b* is hingedly connected to the base panel 14 by a second foldable gusset in the form of a second pair of web panels 36*b*, 38*b*, also referred to herein as minor corner panels (the second pair of web panels 36*b*, 38*b* is hinged to a second bevelled or chamfered corner of the base panel 14), the second pair of web panels 36*b*, 38*b* underlies the fourth major corner panel 30*b* in a setup condition. A third web panel 36*b* is hingedly connected to the second securing tab 34*b* by a hinged connection in the form of a fold line 37*b*. A fourth web panel 38*b* is hingedly connected to the third web panel 36*b* by a hinged connection in the form of a fold line 39*b*. The fourth web panel 38*b* is hingedly connected to the base panel 14 by a hinged connection in the form of a fold line 41*b*.

The fold line 37*b* is substantially collinear with the fold line 13.

Each of the second pair of web panels 36*b*, 38*b* is defined in part by a pair of divergently arranged fold lines 37*b*/39*b*, 39*b*/41*b*.

The blank 10 comprises a second aperture A2 struck from the second pair of web panels 36*b*, 38*b* so as to interrupt the fold lines 37*b*, 39*b*, 41*b*. The second aperture A2 is located at a position at which the fold lines 37*b*, 39*b*, 41*b* would otherwise have intersected with each other and with the fold lines 13 and 35*b*.

The first major corner panel 24*a* is hingedly connected to the base panel 14 by a third foldable gusset in the form of a third pair of web panels 40*a*, 42*a*, also referred to herein as minor corner panels (the third pair of web panels 40*a*, 42*a* is hinged to a third bevelled or chamfered corner of the base panel 14), the third pair of web panels 40*a*, 42*a* underlies the first major corner panel 24*a* in a setup condition. A fifth web panel 40*a* is hingedly connected to the base panel 14 by a hinged connection in the form of a fold line 43*a*. A sixth web panel 42*a* is hingedly connected to the fifth web panel 40*a* by a hinged connection in the form of a fold line 45*a*. The sixth web panel 42*a* is hingedly connected to the first major corner panel 24*a* by a hinged connection in the form of a fold line 47*a*.

The fold line 47*a* is substantially collinear with the fold line 15.

Each of the third pair of web panels 40*a*, 42*a* is defined in part by a pair of divergently arranged fold lines 43*a*/45*a*, 45*a*/47*a*.

The blank 10 comprises a third aperture A3 struck from the third pair of web panels 40*a*, 42*a* so as to interrupt the fold lines 43*a*, 45*a*, 47*a*. The third aperture A3 is located at a position at which the fold lines 43*a*, 45*a*, 47*a* would otherwise have intersected with each other and with the fold lines 15 and 23*a*.

The second major corner panel 24*b* is hingedly connected to the base panel 14 by a fourth foldable gusset in the form of a fourth pair of web panels 40*b*, 42*b* also referred to herein as minor corner panels (the fourth pair of web panels 40*b*, 42*b* is hinged to a fourth bevelled or chamfered corner of the base panel 14), the fourth pair of web panels 40*b*, 42*b* underlies the second major corner panel 24*b* in a setup condition. A seventh web panel 40*b* is hingedly connected to the base panel 14 by a hinged connection in the form of a fold line 43*b*. An eighth web panel 42*b* is hingedly connected to the seventh web panel 40*b* by a hinged connection in the form of a fold line 45*b*. The eighth web panel 42*b* is hingedly connected to the second major corner panel 24*b* by a hinged connection in the form of a fold line 47*b*.

The fold line 47*b* is substantially collinear with the fold line 15.

Each of the fourth pair of web panels 40*b*, 42*b* is defined in part by a pair of divergently arranged fold lines 43*b*/45*b*, 45*b*/47*b*.

The blank 10 comprises a fourth aperture A4 struck from the fourth pair of web panels 40*b*, 42*b* so as to interrupt the fold lines 43*b*, 45*b*, 47*b*. The fourth aperture A4 is located at a position at which the fold lines 43*b*, 45*b*, 47*b* would otherwise have intersected with each other and with the fold lines 15 and 23*b*.

The first major corner panel 24*a* is hingedly connected to the top panel 18 by a fifth foldable gusset in the form of a fifth pair of web panels 44*a*, 46*a*, also referred to herein as minor corner panels (the fifth pair of web panels 44*a*, 46*a* is hinged to a first bevelled or chamfered corner of the top panel 18), the fifth pair of web panels 44*a*, 46*a* underlies the first major corner panel 24*a* in a setup condition. A ninth web panel 44*a* is hingedly connected to the first major corner panel 24*a* by a hinged connection in the form of a fold line 49*a*. A tenth web panel 46*a* is hingedly connected to the ninth web panel 44*a* by a hinged connection in the form of a fold line 51*a*. The tenth web panel 46*a* is hingedly connected to the top panel 18 by a hinged connection in the form of a fold line 53*a*.

The fold line 49*a* is substantially collinear with the fold line 17.

Each of the fifth pair of web panels 44*a*, 46*a* is defined in part by a pair of divergently arranged fold lines 49*a*/51*a*, 51*a*/53*a*.

The blank 10 comprises a fifth aperture A5 struck from the fifth pair of web panels 44*a*, 46*a* so as to interrupt the fold lines 49*a*, 51*a*, 53*a*. The fifth aperture A5 is located at a position at which the fold lines 49*a*, 51*a*, 53*a* would otherwise have intersected with each other and with the fold lines 17 and 23*a*.

The second major corner panel 24*b* is hingedly connected to the top panel 18 by a sixth foldable gusset in the form of a sixth pair of web panels 44*b*, 46*b*, also referred to herein as minor corner panels (the sixth pair of web panels 44*b*, 46*b* is hinged to a second bevelled or chamfered corner of the top panel 18), the sixth pair of web panels 44*b*, 46*b* underlies the second major corner panel 24*b* in a setup condition. An eleventh web panel 44*b* is hingedly connected to the second major corner panel 24*b* by a hinged connection in the form of a fold line 49*b*. A twelfth web panel 46*b* is hingedly connected to the eleventh web panel 44*b* by a hinged connection in the form of a fold line 51*b*. The twelfth web panel 46*b* is hingedly connected to the top panel 18 by a hinged connection in the form of a fold line 53*b*.

The fold line 49*b* is substantially collinear with the fold line 17.

Each of the sixth pair of web panels 44*b*, 46*b* is defined in part by a pair of divergently arranged fold lines 49*b*/51*b*, 51*b*/53*b*.

The blank 10 comprises a sixth aperture A6 struck from the sixth pair of web panels 44*b*, 46*b* so as to interrupt the fold lines 49*b*, 51*b*, 53*b*. The sixth aperture A6 is located at a position at which the fold lines 49*b*, 51*b*, 53*b* would otherwise have intersected with each other and with the fold lines 17 and 23*b*.

The third major corner panel 30*a* is hingedly connected to the top panel 18 by a seventh foldable gusset in the form of a seventh pair of web panels 48*a*, 50*a*, also referred to herein as minor corner panels (the seventh pair of web panels 48*a*, 50*a* is hinged to a third bevelled or chamfered corner of the top panel 18), the seventh pair of web panels 48*a*, 50*a* underlies the third major corner panel 30*a* in a setup condition. A thirteenth web panel 48*a* is hingedly connected to the top panel 18 by a hinged connection in the form of a fold line 55*a*. A fourteenth web panel 50*a* is hingedly connected to the thirteenth web panel 48*a* by a hinged connection in the form of a fold line 57*a*. The fourteenth web panel 50*a* is hingedly connected to the third major corner panel 30*a* by a hinged connection in the form of a fold line 59*a*.

The fold line 59*a* is substantially collinear with the fold line 19.

Each of the seventh pair of web panels 48*a*, 50*a* is defined in part by a pair of divergently arranged fold lines 55*a*/57*a*, 57*a*/59*a*.

The blank 10 comprises a seventh aperture A7 struck from the seventh pair of web panels 48*a*, 50*a* so as to interrupt the fold lines 55*a*, 57*a*, 59*a*. The seventh aperture A7 is located at a position at which the fold lines 55*a*, 57*a*, 59*a* would otherwise have intersected with each other and with the fold lines 19 and 31*a*.

The fourth major corner panel 30*b* is hingedly connected to the top panel 18 by an eighth foldable gusset in the form of an eighth pair of web panels 48*b*, 50*b*, also referred to herein as minor corner panels (the eighth pair of web panels 48*b*, 50*b* is hinged to a fourth bevelled or chamfered corner of the top panel 18), the eighth pair of web panels 48*b*, 50*b* underlies the fourth major corner panel 30*b* in a setup condition. A fifteenth web panel 48*b* is hingedly connected to the top panel 18 by a hinged connection in the form of a fold line 55*b*. A sixteenth web panel 50*b* is hingedly connected to the fifteenth web panel 48*b* by a hinged connection in the form of a fold line 57*b*. The sixteenth web panel 50*b* is hingedly connected to the fourth major corner panel 30*b* by a hinged connection in the form of a fold line 59*b*.

The fold line 59*b* is substantially collinear with the fold line 19.

Each of the eighth pair of web panels 48*b*, 50*b* is defined in part by a pair of divergently arranged fold lines 55*b*/57*b*, 57*b*/59*b*.

The blank 10 comprises an eighth aperture A8 struck from the eighth pair of web panels 48*b*, 50*b* so as to interrupt the fold lines 55*b*, 57*b*, 59*b*. The eighth aperture A8 is located at a position at which the fold lines 55*b*, 57*b*, 59*b* would otherwise have intersected with each other and with the fold lines 19 and 31*b*.

The blank 10 may comprise a handle structure H. The handle structure H may be provided at least in part in the rear side panel 16. The handle structure H comprises a handle opening or slot defined in the rear side panel 16. The handle opening may be defined at least in part by a first handle tab 60*a*. The first handle tab 60*a* is struck from the rear side panel 16 and is hinged connected thereto by a hinged connection in the form of a fold line 61*a*. The handle opening may be defined at least in part by a second handle tab 60*b*. The second handle tab 60*b* is struck from the rear side panel 16 and is hinged connected thereto by a hinged connection in the form of a fold line 61*b*. The second handle tab 60*b* is hinged in opposition to the first handle tab 60*a*. The second handle tab 60*b* is separated from, or severable from, the first handle tab 60*a* by a common cut line or severance line 63.

The handle structure H may extend into the adjacent panels, into the base panel 14 and the top panel 18. The severance line 63 may extend into each of the base and top panels 14, 18, a first severance line extension 63*a* may be provided in the base panel 14. A second severance line extension 63*b* may be provided in the top panel 18. The handle structure H comprises a relief structure, the relief structure may redirect or distribute load forces in the handle structure through the carton and or onto the contents (articles B) in the carton.

The relief structure comprises a cutline extending from the end of the first and second severance line extensions 63*a*, 63*b*. Each cutline is divergently arranged with respect to the first and second severance line extensions 63*a*, 63*b* from which it extends. The cut line may be 'V' or 'U' shaped. Each cut line is arranged so as to converge at the end of the first and second severance line extension 63*a*, 63*b*. The cutline and the respective first or second severance line extension 63*a*, 63*b* diverges from the respective first or second severance line extensions 63*a*, 63*b* towards the rear side panel 16.

The base panel 14 comprises a pair of divergently arranged fold lines 65*a*, 65*b*, extending from the cutline towards the rear side panel 16. The rear side panel 16 comprises a pair of divergently arranged fold lines 67*a*, 67*b*, extending from the cutline towards the rear side panel 16.

The blank 10 comprises an access device or dispenser D for gaining access to an interior of the carton 90 so as to be able to remove the carton contents.

The dispenser D comprises a detachable panel 70*a*/70*b*. A first portion 70*a* of the detachable panel 70*a*/70*b* is struck from the top panel 18 and second portion 70*b* of the detachable panel 70*a*/70*b* is struck from the front side panel 20. The second portion of the detachable panel 70*b* is hingedly connected to the first portion 70*a* by the fold line 19.

The detachable panel 70*a*/70*b* is defined in part by second, fourth and fifth severance lines or tear lines 71*b*, 71*a*, 71 provided in the top panel 18. The detachable panel 70*a*/70*b* is defined in part by first and third severance lines or tear lines 73*b*, 73*a* provided in the front side panel 20. The first tear line 73*b* is divergently arranged with respect to the third tear line 73*a*.

The fourth tear line 71*a* extends from the seventh aperture A7. The second tear line 71*b* extends from the eighth aperture A8. The fifth tear line 71 may be substantially 'U' shaped or semi-circular. The fifth tear line 71 continuously extends across the top panel 18 between the second and fourth tear lines 71*b*, 71*a*.

The third tear line 73*a* extends from the seventh aperture A7 to a tear initiator 70*c*, and the first tear line 73*b* extends from the eight aperture A8 to the tear initiator 70*c*.

In this way, a portion of each of the seventh and eighth apertures A7, A8 defines an edge or part of the detachable panel 70*a*/70*b*.

The tear initiator comprises a foldable tab 70*c* hinged to the second portion 70*b* of the detachable panel 70*a*/70*b* by a fold line 75; The foldable tab 70*c* is defined in part by 'U' shaped or semi-circular cutline, although in other embodiments other shapes may be employed.

The dispenser D comprises a tear barricade or control feature. The tear control feature directs or maintains the course or direction of the tear when deploying the dispenser D by detaching detachable panel 70*a*/70*b*. In particular, the tear control feature directs or maintains the course or direction of the tear when the tear transitions from the front side panel 20 into the top panel 18, that is to say, when the tear crosses the fold line 19 between the front side panel 20 and the top panel 18.

The tear control feature comprises a tear barricade line 79*a*, 79*b*. The tear barricade line 79*a*, 79*b* may be non-linear in shape. The tear barricade line 79*a*, 79*b* may be arcuate or curvilinear in shape.

The tear barricade line 79*a*, 79*b* is arranged to extend from a first end proximate, and spaced apart from, the fold line 19 to a second end proximate, and spaced apart from, a respective one of the seventh and eighth apertures A7, A8.

The tear barricade lines 79*a*, 79*b* define, in part, displaceable or deformable regions in the top panel 18, in the first portion 70*a* of the detachable panel 70*a*/70*b*. When the dispenser D is deployed or activated by removing the detachable panel 70*a*/70*b* the deformable regions in the first portion 70*a* of the detachable panel 70*a*/70*b* may be displaced or deformed with respect to adjacent regions of the first portion 70*a* such that shearing forces are directed towards the fourth and second tear lines 71*a*, 71*b* proximate the seventh and eighth apertures A7, A8 respectively.

The blank 10 may comprise a hinged connection 77 in the form of a plurality of spaced apart partial depth cut lines. The hinged connection 77 may be a score line, embossed or debossed line in other embodiments and defines foldable region in the top panel 18 proximate the fifth tear line 71. A portion of the hinged connection may be arranged to form a parallel curve or offset curve which extends alongside of the fifth tear line 71. In this way said portion of the hinged connection 77 is similarly shaped to the fifth tear line 71.

Turning to the construction of the package as illustrated in FIG. 3, the article carrier 90 can be formed by a series of sequential folding operations. The folding process is not limited to that described below and may be altered according to particular manufacturing requirements.

The blank 10 is folded about fold line 15 such that the base panel 14 is brought into overlying relationship with the rear side panel 16, and with part of the top panel 18, the securing flap is brought into overlying relationship with the top panel 18.

Glue or other adhesive treatment is applied to the securing flap 12 and to the first and second securing tabs 34*a*, 34*b*. In other embodiments the glue may be applied to corresponding regions of an inner surface of the front side panel 20 and the third and fourth corner panels 30*a*, 30*b*.

The blank 10 is folded about fold line 19 such that the front side panel 20 is brought into overlying relationship with the top panel 18 and into face contacting relationship with the securing flap 12. A portion of each of the third and fourth corner panels 30*a*, 30*b* is brought into overlying relationship with the top panel 18, the third and fourth corner panels 30*a*, 30*b* are brought into face contacting relationship with a respective one of the first and second securing tabs 34*a*, 34*b*.

The front side panel 20 is secured to the securing flap 12. The third major corner panel 30*a* is secured to the first securing tab 34*a*. The fourth corner panel 30*ab* is secured to the second securing tab 34*b*.

In this way the blank 10 is thus formed into a flat collapsed tubular structure which can be readily shipped or distributed to a convertor plant, at which the flat collapsed tubular structure may be erected into an open-ended tubular structure and loaded with articles.

The flat collapsed tubular structure may be erected to form an open-ended tubular structure by unfolding the rear side panel 16 with respect to the base panel 14 such that the rear side panel 16 is disposed substantially perpendicularly with respect to the base panel 14.

The carton 90, in its open-ended tubular form, may be loaded with articles through one or both open ends thereof. It will be appreciated that in some embodiments one of the open ends of the carton 90 may be closed before loading the interior with articles through the remaining open end.

A first end of the tubular structure is closed by folding the first major corner panel 24*a*, about fold line 23*a*, with respect to the rear side panel 16. The fifth and sixth web panels 40*a*, 42*a* are folded internally into face to face relationship with each other. The ninth and tenth web panels 44*a*, 46*a* are folded internally into face to face relationship with each other.

The third major corner panel 30*a* is folded with respect to the front side panel 20, about fold line 31*a*. The first securing tab 34*a* is folded with respect to the securing flap 12, about fold line 35*a*. The thirteenth and fourteenth web panels 48*a*, 50*a* are folded internally into face to face relationship with each other. The first and second web panels 36*a*, 38*a* are folded internally into face to face relationship with each other.

The first side end closure panel 26*a* is folded with respect to the first major corner panel 24*a*, about fold line 25*a*. The second side end closure panel 32*a* is folded with respect to the third major corner panel 30*a*, about fold line 33*a*.

The first bottom end closure flap 22*a* is folded with respect to the base panel 14, about fold line 21*a*.

Glue or other adhesive treatment is applied to the first bottom end closure flap 22*a*. In other embodiments the glue may be applied to corresponding regions of an inner surface of the first top end closure flap 28*a*.

The first top end closure flap 28*a* is folded with respect to the top panel 18, about fold line 27*a*.

The first top end closure flap 28*a* is brought into overlapping relationship with the first bottom end closure flap 22*a*. The first top end closure flap 28*a* is brought into face to face contacting relationship with the first bottom end closure flap 22*a*. The first top end closure flap 28*a* is secured to the first bottom end closure flap 22*a*.

A second end of the tubular structure is closed by folding the second major corner panel 24*b*, about fold line 23*a*, with respect to the rear side panel 16. The seventh and eighth web panels 40*b*, 42*b* are folded internally into face to face relationship with each other. The eleventh and twelfth web panels 44*b*, 46*b* are folded internally into face to face relationship with each other.

The fourth major corner panel 30*b* is folded with respect to the front side panel 20, about fold line 31*b*. The second securing tab 34*b* is folded with respect to the securing flap 12, about fold line 35*b*. The fifteenth and sixteenth web panels 48*b*, 50*b* are folded internally into face to face relationship with each other. The third and fourth web panels 36*b*, 38*b* are folded internally into face to face relationship with each other.

The third side end closure panel 26*b* is folded with respect to the second major corner panel 24*b*, about fold line 25*b*. The fourth side end closure panel 32*b* is folded with respect to the fourth major corner panel 30*b*, about fold line 33*b*.

The second bottom end closure flap 22*b* is folded with respect to the base panel 14, about fold line 21*b*.

Glue or other adhesive treatment is applied to the second bottom end closure flap 22*b*. In other embodiments the glue may be applied to corresponding regions of an inner surface of the second top end closure flap 28*b*.

The second top end closure flap 28*b* is folded with respect to the top panel 18, about fold line 27*b*.

The second top end closure flap 28*b* is brought into overlapping relationship with the second bottom end closure flap 22*b*. The second top end closure flap 28*b* is brought into face to face contacting relationship with the second bottom end closure flap 22*b*. The second top end closure flap 28*b* is secured to the second bottom end closure flap 22*b*.

FIG. 3 shows an assembled article carrier 90. The article carrier comprises a tubular structure defined by the plurality of main or primary panels 12, 14, 16, 18, 20.

Figure 4:
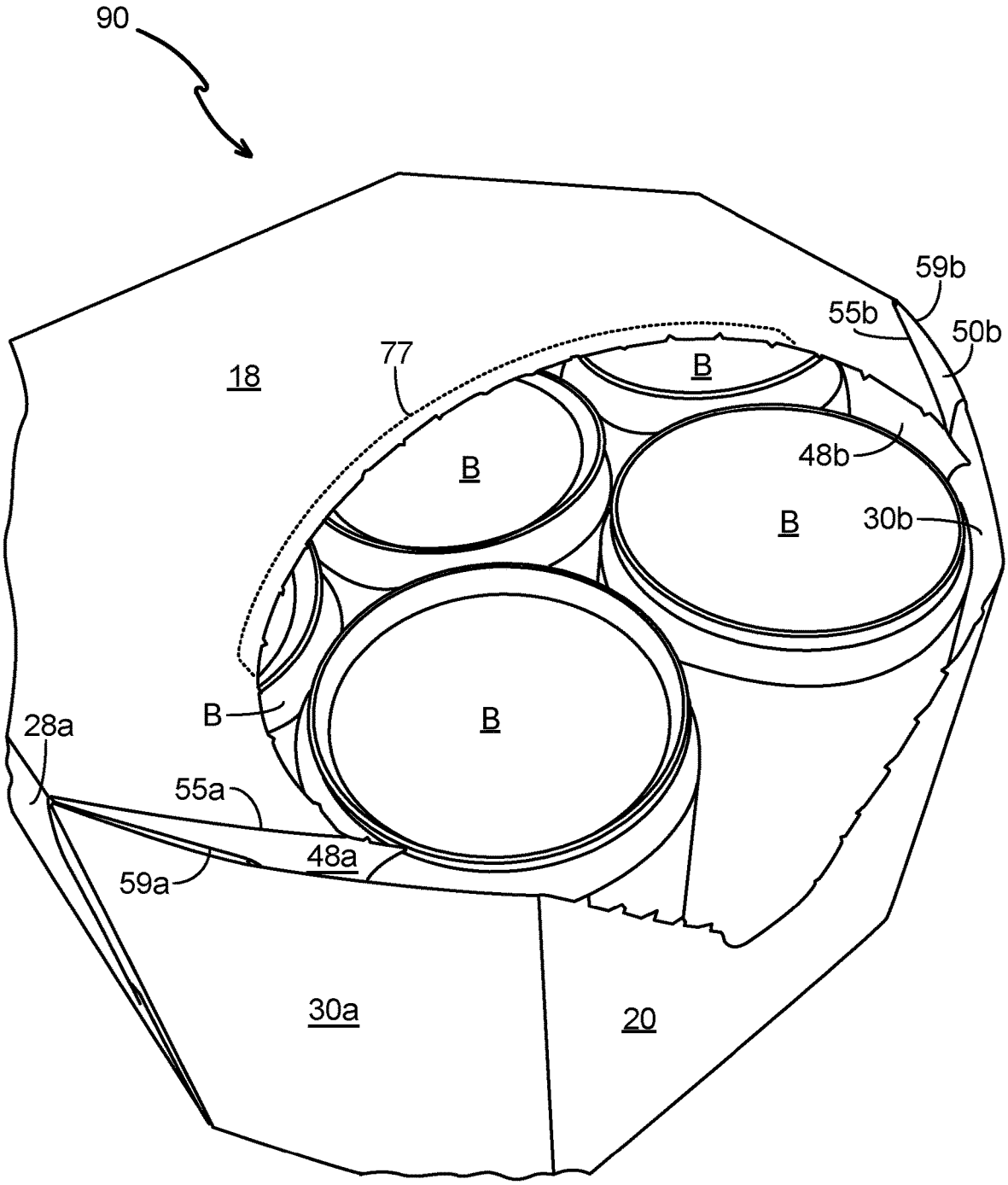
FIG. 4 is a perspective view of a portion of the article carrier of FIG. 3 showing a dispensing feature in a deployed condition.

FIG. 4 shows the article carrier 90 with the dispenser D in a deployed condition, the detachable panel 70*a*/70*b* has been removed to provide an opening through which the carrier's contents can be removed. When the detachable panel 70*a*/70*b* is removed two articles B adjacent to the front side panel 20 are exposed to view and can be readily withdrawn through the opening created.

The tear control feature 79*a*, 79*b* facilitates tearing of the tear lines 73*a*, 73*b*, 71*a*, 71*b* and 71. When the second portion 70*b* of the detachable panel 70*a*/70*b* is unfolded about fold line 19 to commence removal of the first portion 70*a* the substrate may tend to delaminate, that is to say, in inner layer may separate from an outer layer, in regions of the top panel 18 proximate the intersections of the third and first tear lines 73*a*, 73*b* with fold line 19. The tear barricade lines 79*a*, 79*b* have the effect of terminating any such delamination. This may facilitate completion of the tear propagation in third and first tear lines 73*a*, 73*b* such that the second portion 70*b* of the detachable panel 70*a*/70*b* is completely detached from the front side panel 20 and the third and fourth corner panels 30*a*, 30*b*.

In some embodiments the seventh pair of web panels 48*a*, 50*a* may be secured or held against the third corner panel 30*b*, the eighth pair of web panels 48*b*, 50*b* may be secured or held against the fourth corner panel 30*a*. This may be achieved by use of adhesive or alternatively by an article disposed adjacent to the seventh pair of web panels 48*a*, 50*a* and the eighth pair of web panels 48*b*, 50*b* respectively. In this way, the article may restrict or inhibit movement of the seventh or eighth pairs of web panels 48*a*/50*a*, 48*b*/50*b*, which may facilitate commencement of tearing in the fourth and second tear lines 71*a* and 71*b*.

Referring now to FIGS. 5 and 6 there is shown an alternative embodiment of the present disclosure. In the second illustrated embodiment, like numerals have, where possible, been used to denote like parts, albeit with the addition of the prefixes "100" to indicate that these features belong to the second embodiment. The second embodiment shares many common features with the embodiment of FIGS. 1 to 4, therefore only the differences from the embodiment illustrated in FIGS. 1 to 4 will be described in any greater detail.

FIG. 5 shows a blank 110 for forming an article carrier or carton 190 (see FIG. 6) according to a second embodiment. The blank 110 comprises a plurality of primary panels 112, 114, 116, 118, 120 for forming a tubular structure. The plurality of primary panels 112, 114, 116, 118, 120 comprises a securing flap 112, a base panel 114, a rear side panel 116, a top panel 118, and a front side panel 120. The plurality of primary panels 112, 114, 116, 118, 120 may be hingedly connected to each other, one to the next, in a linear series by a respective one of a plurality of hinged connections in the form of fold lines 113, 115, 117, 119.

The blank 110 comprises an access device or dispenser D for gaining access to an interior of the carton 190 so as to be able to remove the carton contents.

The dispenser D comprises a detachable panel 170*a*/170*b*. In the second illustrated embodiment the position and or orientation of the detachable panel has been changed with respect to the detachable panel 70*a*/70*b* of the first illustrated embodiment.

A first portion 170*a* of the detachable panel 170*a*/170*b* is struck from the top panel 118 and a second portion 170*b* of the detachable panel 170*a*/170*b* is struck from the second top end closure panel 128*b*. The second portion of the detachable panel 170*b* is hingedly connected to the first portion 170*a* by the fold line 127*b*.

The detachable panel 170*a*/170*b* is defined in part by second, fourth and fifth severance lines or tear lines 171*a*, 171*b*, 171 provided in the top panel 118. The detachable panel 170*a*/170*b* is defined in part by first and third severance lines or tear lines 173*a*, 173*b* provided in the second top end closure panel 128*b*. The first tear line 173*a* is divergently arranged with respect to the third tear line 173*b*.

The fifth tear line 171 extends across the top panel 118 from the second tear line 171*a* to the fourth tear line 171*b*. The fourth tear line 171*b* is coincident with part of the fold line 153*b*; the fourth tear line 171*b* extends from a first corner of the second top end closure panel 128*b*. A second tear line 171*a* is coincident with part of the fold line 155*b*; the second tear line 171*a* extends from a second, adjacent, corner of the second top end closure panel 128*b*. The fifth tear line 171 may be substantially 'U' shaped or semi-circular and continuously extends between the second and fourth tear lines 171*a*, 171*b*.

The first tear line 173*a* extends from the second corner of the second top end closure panel 128*b* to a tear initiator 170*c* and the third tear line 173*b* extends from the first, adjacent, corner of the second top end closure panel 128*b* to the tear initiator 170*c*.

In this way, the second and fourth tear lines 171*a*, 171*b* are continuous or contiguous with first and third tear lines 173*a*, 173*b*, respectively.

The tear initiator comprises a foldable tab 170*c* hinged to the second portion 170*b* of the detachable panel 170*a*/170*b* by a fold line 175; The foldable tab 170*c* is defined in part by a cutline, the cutline may be 'U' shaped or semi-circular cutline, although in other embodiments other shapes may be employed. The cutline of the tear initiator is continuous or contiguous with and extends between the first and third tear lines 173*a*, 173*b*; in this way a continuous, closed, loop is formed.

The dispenser D comprises a tear barricade or control feature 179*a*, 179*b*. The tear control feature 179*a*, 179*b* directs or maintains the course or direction of the tear when deploying the dispenser D by detaching detachable panel 170*a*/170*b*. In particular, the tear control feature directs or maintains the course or direction of the tear when the tear transitions from the second top end closure panel 128*b* into the top panel 118, that is to say, when the tear crosses the fold line 127*b* between the second top end closure panel 128*b* and the top panel 118.

The tear control feature comprises tear barricade lines 179*a*, 179*b*. The tear barricade lines 179*a*, 179*b* each may be non-linear in shape. The tear barricade lines 179*a*, 179*b* each may be arcuate or curvilinear in shape.

The tear barricade line 179*b* is arranged to extend from a first end proximate, and spaced apart from, the fold line 153*b* (and the fourth tear line 171*b*) to a second end proximate, and spaced apart from, the fold line 127*b*.

Figure 5B:
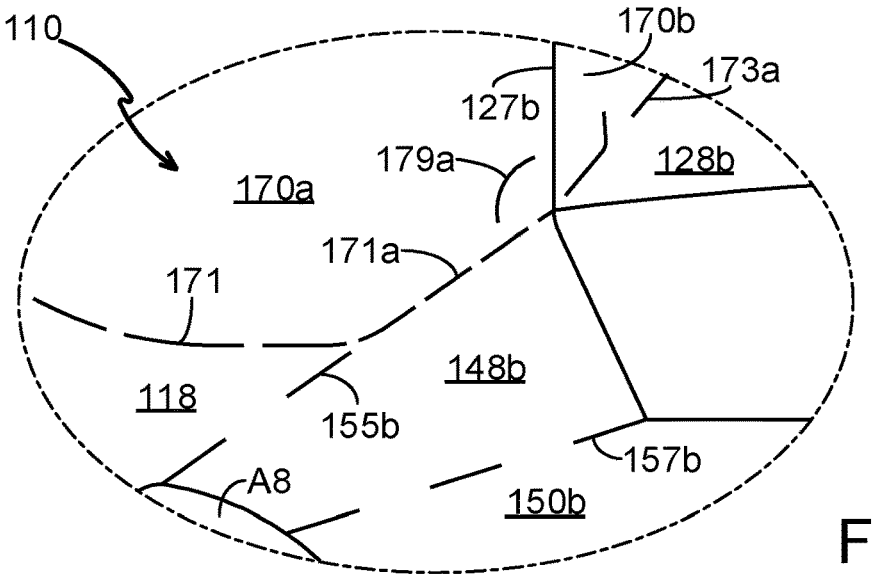
FIG. 5B is an enlarged view of a portion of the blank of FIG. 5A.

The tear barricade line 179*a* is arranged to extend from a first end proximate, and spaced apart from, the fold line 155*b* (and the second tear line 171*a*) to a second end proximate, and spaced apart from, the fold line 127*b*, which is best illustrated in FIG. 5B.

The tear barricade lines 179*a*, 179*b* define in part displaceable or deformable regions in the top panel 118, in the first portion 170*a* of the detachable panel 170*a*/170*b*. When the dispenser D is deployed or activated by removing the detachable panel 170*a*/170*b*, the deformable regions in the first portion 170*a* of the detachable panel 170*a*/170*b* may be displaced or deformed with respect to adjacent regions of the first portion 170*a* such that shearing forces are directed towards or along the second and fourth tear lines 171*a* and 171*b*.

The present disclosure provides a package comprising a carton or article carrier 90; 190 loaded with one or more articles. The carton 90; 190 comprises a plurality of main or primary panels defining an interior of the carton 90; 190. The plurality of primary panels comprises a second primary panel 18; 118, which may form a top panel of the carton 90; 190, and a first primary panel 20; 128*b*, which may form a side or end panel of the carton 90; 190. The first primary panel 20; 128*b* is hingedly connected to the second primary panel 18; 118. An end closure panel 30*b*; 130*b* is hingedly connected to the second primary panel 18; 118. The carton 90; 190 comprises a foldable gusset 48*b*/50*b*; 148*b*/150*b*, formed from the fifteenth and sixteenth web panels 148*b*, 150*b*; 148*b*, 150*b*, for placement into the interior of the carton 90; 190. The gusset 48*b*/50*b*; 148*b*/150*b* is hingedly connected between the end closure panel 30*b*; 130*b* and the first primary panel 20; 128*b*.

The carton 90; 190 further comprises an opening feature D which is at least partially removable from the carton 90; 190. The opening feature D is defined at least in part by first and second tear lines 73*b*, 71*b*; 173*a*, 171*a*.

The second tear line 71*b*; 171*a* may be coextensive or coincident with a portion of an edge of second primary panel 18; 118, the edge being defined at least in part by a hinged connection 55*b*, 155*b* to the gusset 48*b*/50*b*; 148*b*/150*b*

A gusset opening A8 is defined in at least in the gusset 48*b*/50*b*; 148/150*b*. The first and second tear lines 73*b*, 71*b* may each extend from the gusset opening A8.

The second tear line 71*b* which is coextensive or coincident with the portion of the edge of second primary panel 18 may be defined, at least in part, by the gusset opening A8.

The first tear line 73*b* may extend in one of the second primary panel 18, the first primary panel 20 and the end closure panel 30*b*, and the second tear line 71*b* may extend in another one of the second primary panel 18, the first primary panel 20 and the end closure panel 30*b*.

The present disclosure also provides a carton or article carrier 90; 190 comprising a plurality of panels defining an interior of the carton 90; 190. The plurality of panels comprises first panel 20; 128*b* and second panel 18; 118 hingedly connected together along a fold line 19; 127*b*. The carton 90; 190 comprises an opening feature D which is at least partially removable from the carton 90; 190. The opening feature D is defined at least in part by second tear line 71*b*; 171*a*, the first tear line 73*b*, 173*a* extending between the fold line 19; 127*b* and a tear initiation feature 70*c*, 170*c* located in the first panel 20; 128*b*. The second tear line 71*b*; 171*a* extends obliquely with respect to the fold line 19; 127*b* such that an obtuse angle is subtended between the fold line 19; 127*b* and the second tear line 71*b*; 171*a*. The carton comprises a tear barricade line 79*a*; 179*a* formed in that portion of the second panel 18; 118 where the obtuse angle is subtended.

The second tear line 71*b* may be defined at least in part by an edge of an opening A8. The tear barricade line 79*b*; 179*a* may be located adjacent to an intersection of the fold line 19; 127*b* and the first tear line 73*b*, 173*a*.

The present disclosure also provides a carton 90; 190 comprising a second panel 18; 118 and a first panel (or end or side panel) 20; 128*b* hinged to the second panel 18; 118 along a first fold line 19; 127*b*. The carton 90; 190 comprises a first corner panel 48*b*; 148*b* hinged to the second panel 18; 118 along a second fold line 55*b*; 155*b*. The carton 90; 190 comprises a second corner panel 48*a*; 146*b* hinged to the second panel 18; 118 along a third fold line 55*a*; 153*b*. The first fold line 19; 127*b* is disposed between the second and third fold lines 55*b*, 55*a*; 155*b*, 153*b* such that the second and third fold lines 55*b*, 55*a*; 155*b*, 153*b* extend divergently away from the first fold line 19; 127*b*. The carton further comprises an opening feature D which is at least partially removable from the carton 90; 190. The opening feature D comprises a tear initiation feature 70*c*; 170*c* located in the first panel (or end or side panel) 20; 128*b* and defined at least in part by first, second, third and fourth tear lines 73*b*, 71*b*, 73*a*, 71*a*; 173*a*, 171*a*, 173*b*, 171*b*. The first and third tear lines 73*b*, 73*a*; 173*a*, 173*b* extending divergently from the tear initiation feature 70*c*; 170*c* toward the first fold line 19; 127*b*. The second and fourth tear lines 71*b*, 71*a*; 171*a*, 171*b* being coextensive with the second and third fold lines 55*b*, 55*a*; 155*b*, 153*b* respectively.

The first tear line 73*b*; 173*a* may extend between the tear initiation feature 70*c*; 170*c* and one end of the first fold line 19; 127*b* and the third tear line 73*a*; 173*b* extends between the tear initiation feature 70*c*; 170*c* and the other, opposite, end of the first fold line 19; 127*b*.

It can be appreciated that various changes may be made within the scope of the present invention. For example, the size and shape of the panels may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "coextensive with" as used herein refers to colinear alignment of two or more linear elements either in a carton blank or in an erected carton, such as a severance line in a panel and part of a fold line in the same panel. Those linear elements coextensive with each other may be aligned with each other in the direction of the length of those linear elements. For example, when a tear line is "coextensive with" a fold line, part of the fold line may serve as fold line as well as a tear line.

The invention claimed is:

1. A carton for packaging one or more articles, the carton comprising a plurality of panels defining an interior of the carton, the plurality of panels comprising:

a first panel;

a second panel hingedly connected to the first panel;

an end closure panel hingedly connected to the first panel; and a foldable gusset for placement into the interior of the carton, the gusset hingedly connected between the end closure panel and the second panel and having a gusset opening defined at least in the gusset, wherein the carton further comprises an opening feature which is at least partially removable from the carton, the opening feature is defined at least in part by a first tear line and a second tear line, each of the first and the second tear lines extending from the gusset opening.

2. A carton according to claim 1, wherein the first tear line extends in one of the first panel, the second panel and the end closure panel and the second tear line extends in another one of the first panel, the second panel and the end closure panel.

3. A carton according to claim 1, wherein the second tear line is coextensive with at least a portion of an edge of the second panel, the edge being defined at least in part by a hinged connection to the gusset.

4. A carton according to claim 3, wherein the second panel forms a top panel of the carton.

5. A carton according to claim 3, wherein the first panel forms a side or end panel of the carton.

6. A carton according to claim 3, wherein the foldable gusset is formed from a pair of web panels hingedly connected to each other.

7. A carton according to claim 6, wherein the pair of web panels comprises:

a first corner panel hinged to the second panel along a second fold line; and a second corner panel hinged to the second panel along a third fold line;

wherein the second panel is hingedly connected to the first panel along a first fold line, the first fold line is disposed between the second and third fold lines such that the second and third fold lines extend divergently away from the first fold line, wherein the tear initiation feature is located in the first panel and the opening feature is defined at least in part by third and fourth tear lines, the first and third tear lines extending divergently from the tear initiation feature toward the first fold line, the second and fourth tear lines being coextensive with the second and third fold lines respectively.

8. A carton according to claim 7, wherein the first tear line extends between the tear initiation feature and the one of the opposite ends of the first fold line and the third tear line extends between the tear initiation feature and the other of the opposite ends of the first fold line.

9. A carton according to claim 3, wherein the second tear line which is coextensive with the at least a portion of the edge of second panel is defined, at least in part, by the gusset opening.

10. A carton for packaging one or more articles, the carton comprising a plurality of panels defining an interior of the carton, the plurality of panels comprising a first panel and a second panel hingedly connected together along a fold line, the carton comprising an opening feature which is at least partially removable therefrom, the opening feature being defined at least in part by a first tear line and a second tear line, the first tear line extending between the fold line and a tear initiation feature located in the first panel, the second tear line extending obliquely with respect to the fold line such that an obtuse angle is subtended between the fold line and the second tear line and wherein a tear barricade line is formed in a portion of the second panel where the obtuse angle is subtended.

11. A carton according to claim 10, wherein the second tear line is defined at least in part by an edge of an opening.

12. A carton according to claim 10, wherein the tear barricade line is located adjacent to an intersection of the fold line and the first tear line.

13. A blank for forming a carton, the blank comprising a plurality of panels for defining an interior of the carton, the plurality of panels comprising:

a first panel;

a second panel hingedly connected to the first panel;

an end closure panel hingedly connected to the first panel; and a foldable gusset for placement into the interior of the carton, the gusset hingedly connecting between the end closure panel and the second panel and having a gusset opening defined in at least in the gusset, wherein the blank further comprises an opening feature which is at least partially removable, the opening feature is defined at least in part by a first tear line and a second tear line each extending from the gusset opening.

14. A blank according to claim 13, further comprising:

a first corner panel hinged to the second panel along a second fold line; and a second corner panel hinged to the second panel along a third fold line;

wherein the second panel is hingedly connected to the first panel along a first fold line, the first fold line is disposed between the second and third fold lines such that the second and third fold lines extend divergently away from the first fold line;

wherein the tear initiation feature is located in the first panel, the opening feature being defined at least in part by third and fourth tear lines, the first and third tear lines extending divergently from the tear initiation feature toward the first fold line, the second and fourth tear lines being coextensive at least in part with the second and third fold lines respectively.

15. A blank according to claim 13, wherein the second tear line is coextensive with at least a portion of an edge of the second panel, the edge being defined at least in part by a hinged connection to the gusset.

* * * * *